United States Patent [19]

Johnsson et al.

[11] 4,188,206

[45] Feb. 12, 1980

[54] METALLURGICAL PROCESS

[75] Inventors: Mans K. O. Johnsson; Lars A. Eriksson, both of Hagfors, Sweden

[73] Assignee: Uddeholms Aktiebolag, Uddeholms, Sweden

[21] Appl. No.: 792,790

[22] Filed: May 2, 1977

Related U.S. Application Data

[62] Division of Ser. No. 550,554, Feb. 18, 1975, Pat. No. 4,021,233, which is a division of Ser. No. 295,355, Oct. 5, 1972, Pat. No. 3,867,135.

[30] Foreign Application Priority Data

| | | | |
|---|---|---|---|
| Oct. 8, 1971 | [GB] | United Kingdom | 46507/71 |
| Feb. 28, 1972 | [GB] | United Kingdom | 9162/72 |
| Jun. 9, 1972 | [SE] | Sweden | 7583/72 |

[51] Int. Cl.[2] ..... C21C 5/34

[52] U.S. Cl. ..... 75/60; 75/59

[58] Field of Search ..... 75/59, 60

[56] References Cited

U.S. PATENT DOCUMENTS

| | | | |
|---|---|---|---|
| 3,867,135 | 2/1975 | Johnsson | 75/60 |
| 3,867,136 | 2/1975 | Eriksson | 75/60 |
| 3,898,079 | 5/1975 | Eriksson | 75/60 |
| 3,990,888 | 11/1976 | Eriksson | 75/60 |

*Primary Examiner*—P. D. Rosenberg

*Attorney, Agent, or Firm*—Murray and Whisenhunt

[57] ABSTRACT

The carbon content in iron, cobalt, or nickel based alloys containing at least about 16% chromium is substantially eliminated without significant loss of chromium by blowing the alloy with oxygen to oxidize the carbon and simultaneously introducing steam or ammonia in amounts such that the partial pressure of carbon monoxide (formed by oxidation of carbon) is lower than that which corresponds to the equilibrium pressure for the carbon/chromium oxidation e.g. below 0.95 and preferably below 0.5 atmospheres.

13 Claims, 9 Drawing Figures

Fig.2
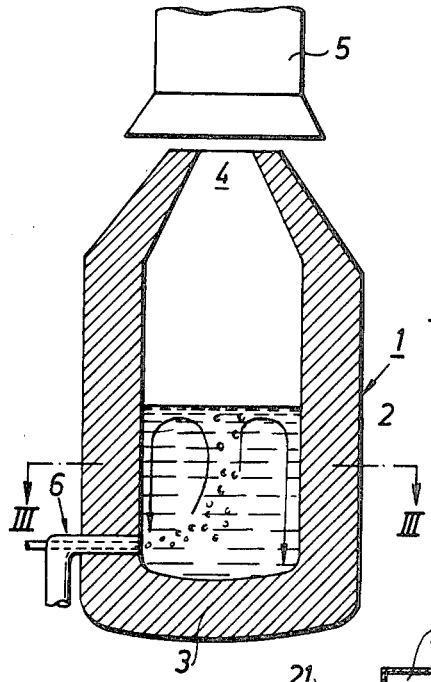
Fig.3
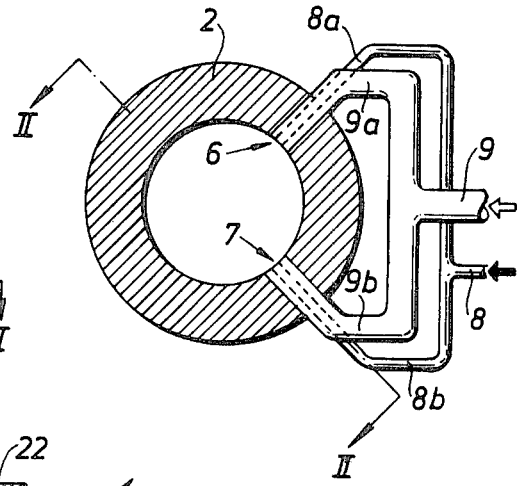
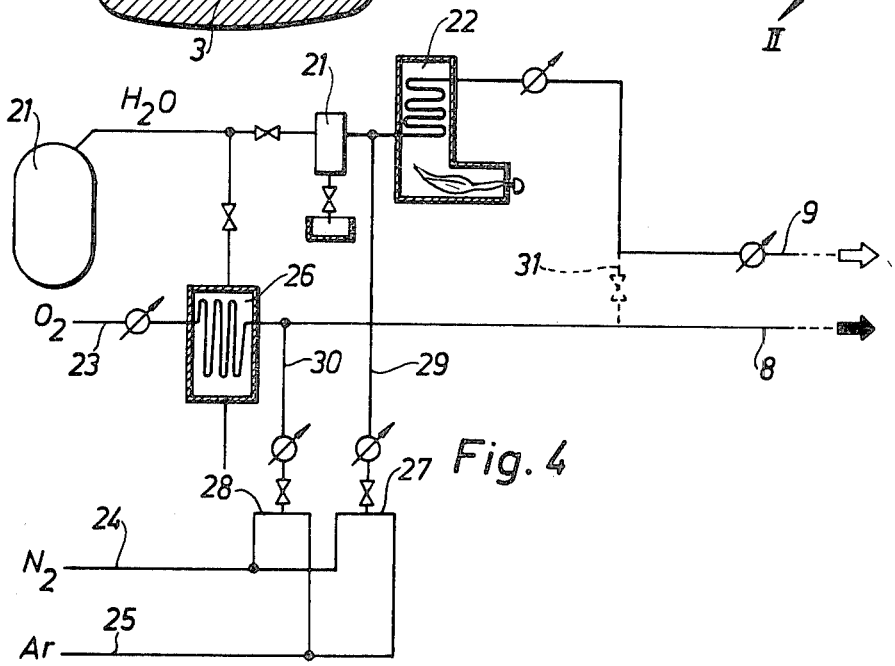
Fig. 4

%Cr %C
Si Mn
°C
22
20
2,0
18
1,5
16
1,0
14
0,5
12
1800
1700
1600
1500
1400
Cr
Temp.
Mn
Si
Cx10
C
Si
10
50
100
min
I
II
III
IV
V
VI
VII
3,0 2,0 1,0 0,6 0 0 O2, mN3/min.
1,0 2,0 3,0 3,0 1,5 H2O, —»—
0,2 Ar NH3 1,0 N2 —»—
R
230 Kg Fe Si 75
400 " CaO
3 1 0,33 0,2 0 O2 : H2O

METALLURGICAL PROCESS

This is a division, of application Ser. No. 550,554 filed Feb. 18, 1975 now U.S. Pat. No. 4,021,233 which is Div. of 295,355, filed Oct. 5, 1972 now U.S. Pat. No. 3,867,135.

The present invention relates to a method of reducing the carbon content of metallic melts containing large amounts of chromium, in particular stainless steel alloys.

When reducing the carbon content of steel melts containing large amounts of chromium, attention must be paid to the temperature-dependent state of equilibrium of carbon, chromium and oxygen and to some extent also silicon. The same applies to the treatment of other metallic melts such as nickel or cobalt based alloys containing large amounts of chromium.

These problems are well known to every producer of stainless steel. In order to obtain a low carbon content together with a high chromium content in the steel bath with a carbon monoxide partial pressure of about 1 atmosphere, the temperature required is so high that the lining material is subjected to heavy wear. In addition, the high temperature is achieved principally by the oxidation of chromium with the oxygen, which leads to considerable chromium losses even though part of the oxidised chromium can be recovered by the use of a low-carbon reducing agent. The most widespread method of overcoming the temperature problem and keeping the chromium losses within reasonable bounds is to melt at a lower chromium content after oxygen-blowing to increase the alloy content of the low-carbon melt with the aid of low-carbon ferrochrome. This low-carbon ferrochrome is, however, comparatively costly, while the chromium losses experienced are no less marked.

In order to overcome this problem the practice has recently been adopted of operating with a reduced carbon monoxide partial pressure in the melt. Following the procedure which has been developed in this connection, this can be achieved by one of two principal methods:

I. Vacuum treatment of a melt oxidised using oxygen or alternatively vacuum refining, generally of a melt oxidised using oxygen;

II. Bubbling through the steel an inert gas, inert gas-/oxygen mixture or in some cases nitrogen or nitrogen-/oxygen/air mixture.

The processes falling under Category I will generally involve the investment and running costs associated with a vacuum plant. Those falling under Category II require a specially-shaped vessel. There are in addition considerable costs relating to the inert gas.

The present invention provides a method of reducing the carbon content of an alloy containing chromium, carbon and as major component at least one of iron, cobalt and nickel which comprises introducing molecular oxygen into the molten alloy to oxidise the carbon to carbon monoxide and introducing into the molten alloy concurrently with or subsequently to the introduction of the oxygen at least one hydrogen containing compound which does not contain carbon and which liberate elementary hydrogen in the molten alloy, the amount of hydrogen containing compound being such that the partial pressure of carbon monoxide is lower than that which corresponds to the equilibrium pressure for the carbon/chromium oxidation.

The present invention thus also employs the fundamental principle of a "low carbon monoxide partial pressure" discussed earlier. A particular feature of the invention in this connection is that a reduced carbon monoxide partial pressure is obtained by introducing a hydrogen containing gas e.g. steam into the melt below its surface, preferably during and/or after the introduction of oxygen into the melt. As an alternative to steam, ammonia can be used either partially or entirely to replace the steam, particularly in those cases where the addition of nitrogen to the melt is either desired or acceptable. In the following discussion, reference will be made to the use of steam or steam and/or ammonia but any hydrogen containing compound not containing carbon can be used.

Reaction of the introduced gases with the melt produces bubbles containing steam and carbon monoxide and these rise to the surface. A certain amount of hydrogen, and also of oxygen, dissolves in the melt and this dissolved hydrogen subsequently leaves the melt in the form of bubbles, whereas the oxygen participates actively in the oxidation processes in the melt. Steam/ammonia is introduced in such quantity and concentration that the carbon content can be reduced to the desired level, principally by the hydrogen from the steam/ammonia diluting the carbon monoxide to the extent required for the carbon to be oxidised to carbon monoxide at a carbon monoxide partial pressure lower than that corresponding to equilibrium pressure needed for the carbon/chromium oxidation reactions. The carbon monoxide partial pressure will normally be less than 0.95 atmospheres and preferably below 0.5 atmospheres, at least during the later stages of decarburisation.

The alloy to be treated contain iron, cobalt or nickel as the major component together with chromium, carbon and usually up to about 3% silicon. The chromium content is at least 10% and preferably at least 16. In the above and following remarks, % are by weight unless otherwise indicated.

The alloys which can be treated in accordance with the invention may particularly be stainless steel, for example ferritic, austenitic or ferritic-austenitic stainless steels containing at least 10% and usually at least 16% chromium, or a cobalt-based or nickel-based alloy containing under 50% iron, for example an INCOLLOY alloy and also INCOLLOY 700 or 800. The alloys may also contain the usual impurities in normal amounts which, in the case of phosphorus and sulphur, means about 0.04%. The alloys may also contain other alloying elements. An austenitic stainless steel will contain at least 8% nickel in addition to iron and chromium and this may be partially or completely replaced by manganese. Molybdenum is another customary alloying element, while nitrogen may also appear in significant amounts. The invention may also find application in the production of other chromium alloys such as ferrochrome and in the refining of melts containing readily oxidised elements other than chromium in significant amounts. For special purposes it is also possible to introduce other substances or diluting gases mixed with the steam.

The introduction of steam into a steel bath has been used in the VLN (very low nitrogen) process, in which crude iron having a high phosphorus content is refined by treatment with a mixture of oxygen and steam. The aim here was to cause the steam to act as a coolant during oxygen blowing, so that the absence of nitrogen in the refining gas would result in a melt low in nitrogen and carbon. The necessary heat of reaction was obtained principally by the combustion of phosphorus and the process was suitable only for the production of plain steel melts or at most low-chromium melts, for which reason the proportion of steam in the gas mixture was not normally high enough for the carbon monoxide partial pressure to be reduced to the levels with which the present invention is concerned.

Mixtures of natural gas and oxygen or similar mixtures are also employed in the so-called OBM process. The purpose of including natural gas or the like here, however, is simply to cool the tuyeres and to avoid the absorption of nitrogen by the steel.

Blowing with pure hydrogen has also been previously proposed and has been used on a small scale for the decarburisation of stainless steel following previous oxygen blowing. This procedure, however, has never been adopted in practice, presumably because of the high explosion risk created when hydrogen is introduced into metallurgical melting furnaces. Instead, the technique of using pure hydrogen in this connection has in recent years been developed in the direction of the "environmental control processes," in which pure hydrogen or hydrogen containing a fairly small amount of steam is brought into intimate contact with the surface of the molten steel bath. The blowing-in of steam, as proposed by the present invention, is neither practised nor indeed aimed at in this earlier process.

The present invention is based on the following observations. If steam is blown into a metallic melt which contains carbon together with a large amount of chromium or another element having a strong affinity for oxygen, the melt being caused to boil by oxygen blowing or other means then the steam will decompose with the result that oxygen is liberated and hydrogen to some extent dissolves in the melt at the point of blowing. The dissolved hydrogen can be carried to all parts of the bath by stirring and diffusion and will pass out of solution in the bubbles which form, either at the time when the bubbles are formed or when they rise through the bath to the surface. Some of the hydrogen produced by the decomposition of the steam passes directly into the gaseous state without first dissolving in the bath. The hydrogen content of the bubbles depends on the hydrogen concentration in the bath, which in turn depends on the steam concentration in the gas blown in, on the intensity of blowing and on the reactions in the melt. If steam is blown in at such a rate and in such concentration that the melt is to a high degree saturated with hydrogen, the hydrogen content of the bubbles is high and the carbon monoxide partial pressure consequently low. At the same time the oxygen liberated from the steam participates in the oxidation processes in the melt. If this quantity of oxygen plus the quantity which was in the melt previously is sufficiently great, or if oxygen is introduced in the requisite quantity at the same time as steam is blown in, the carbon content may be reduced to a very low level because of the low carbon monoxide partial pressure, since the oxygen potential of the carbon falls abruptly with a falling carbon monoxide partial pressure. (The lower the oxygen potential which a substance possesses, the lower the oxygen activity required for that substance to be oxidised). The temperature can meanwhile be kept relatively low since the equilibrium temperature in the carbon and chromium equilibrium system also falls with a falling carbon monoxide partial pressure at a certain carbon content level, so that the chromium losses can be kept low, i.e. corresponding almost exclusively to the chromium oxidation due to kinetic factors.

In the operation of the present invention, it is preferred to maintain the carbon monoxide partial pressure below 0.95 atmospheres and preferably below 0.5 atmospheres. The hydrogen containing compound is preferably introduced into the molten alloy at a level at least 20 cm. and particularly at least 50 cm. below the surface of the molten alloy. The decarburisation is desirably carried out at a temperature of 1550°–1800° C., and more particularly at 1600°–1750° C., i.e. the molten alloy should be maintained at this temperature during introduction of the oxygen to oxidise the carbon to carbon monoxide. The volume ratio of introduced oxygen to introduced hydrogen containing compound is advantageously below 3:1 and is preferably in the range 1:1 to 1:10. After decarburisation, any excess hydrogen present in the molten alloy may be removed by blowing a scavenging gas which contains no hydrogen through the molten alloy.

As a preliminary to decarburisation, the temperature of the molten alloy may be raised to the desired level e.g. 1550°–1800° C., by oxidising any silicon present in the alloy and, if there is insufficient silicon present in the alloy to raise the temperature to the desired level, another readily oxidised component of the alloy, e.g. chromium, may be oxidised to raise the temperature. Any chromium oxidised during this preliminary treatment, or at any other time during treatment, collects in a slag which forms over the molten alloy and the chromium in this slag may be recovered by reduction. It is also possible to maintain the pressure above the surface of the molten alloy at below atmospheric. In a preferred embodiment of the invention as applied to the treatment of stainless steel containing at least 16% chromium, the carbon content may be reduced by a process wherein:

(a) the temperature of the molten alloy is first brought up to a temperature of 1550°–1800° C., by burning silicon and/or any other readily oxidised element in the steel, (b) during oxidation of the carbon, a mixture of oxygen and at least one of steam and ammonia is introduced into the molten alloy at least 50 cm. below the surface of the alloy, the mixture containing at least 50% by volume of steam and/or ammonia which reacts chemically with the alloy forming bubbles, containing hydrogen and carbon monoxide, which rise to the surface of the molten alloy, (c) during the oxidation of the carbon, the temperature of the molten alloy is maintained at 1550°–1800° C., essentially by the oxidation of chromium in the alloy, the resulting chromium oxide being accumulated as a slag on the surface of the molten alloy, and (d) after the oxidation of the carbon, the oxidised chromium is recovered by reduction of the slag.

Reference will now be made to the attached drawings, in which:

FIG. 2 shows schematically a vertical section along the line II—II in FIG. 3 through a converter used in accordance with the present invention;

FIG. 3 shows the converter of FIG. 2 in horizontal section along the line III—III in FIG. 2;

FIG. 4 shows schematically a gas supply system used in accordance with the present invention;

Figure 1:
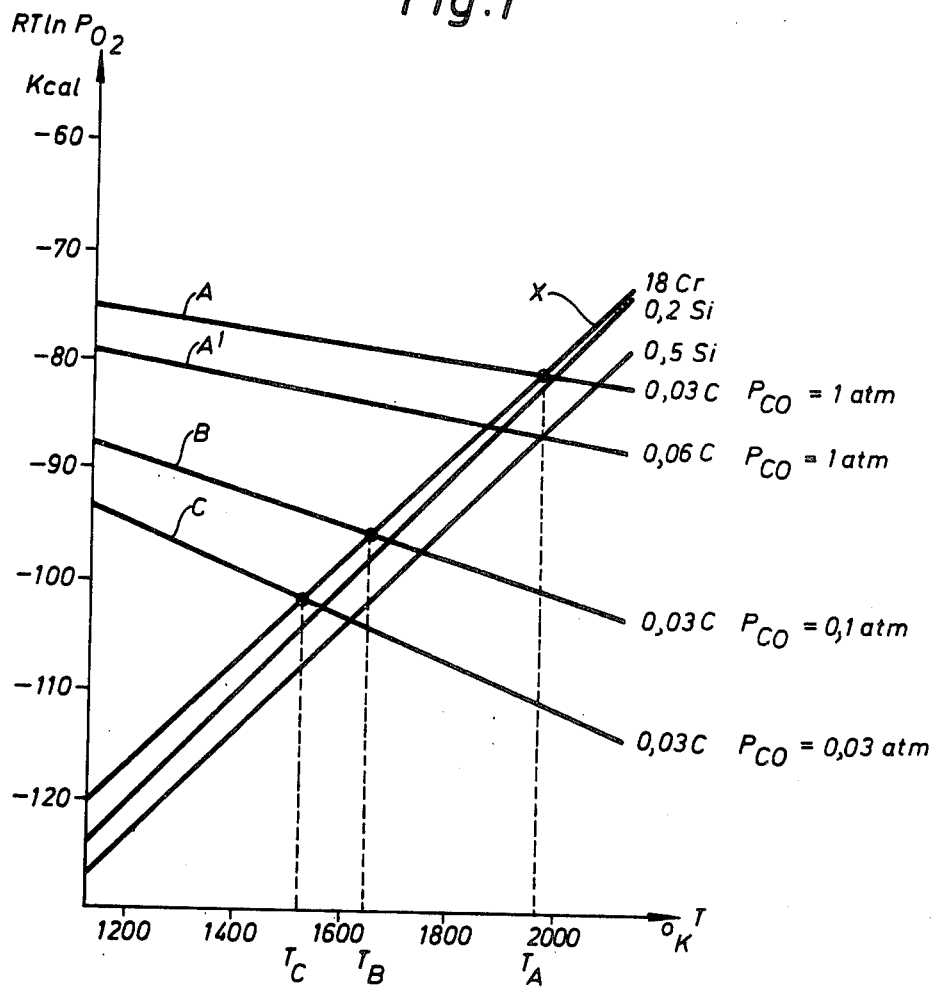
FIG. 1 shows the oxygen potential of various elements in a melt as a function of the absolute temperature.

FIG. 1 illustrates the theory which explains the practical results which experiments show can be achieved with the aid of the invention. The diagram in FIG. 1 represents an oxygen potential diagram well-known per se, i.e. a diagram which indicates an oxygen partial pressure which is in equilibrium with a melt of given composition and at a given temperature, the oxygen potential RT ln $P_{O2}$ for a given alloying constituent being expressed as a function of the absolute temperature T. In the expression for the oxygen potential the symbols have the following meanings:

R=general gas constant

T=absolute temperature, °K.

$P_{O2}$=partial pressure of oxygen.

In the diagram in FIG. 1, curves A, B and C describe the oxygen potential of carbon as a function of the absolute temperature, i.e. they show the equilibrium condition for the reaction $$2C+O_2(g)=2CO(g) \quad (1)$$

with a given carbon content (in the example 0.03% C) at different temperatures and with three separate carbon monoxide partial pressures (in the example 1 atmosphere, 0.1 atmosphere and 0.03 atmosphere). Curve A' shows the equilibrium condition for the same reaction (1) with the same carbon monoxide partial pressure (1 atmosphere) as for Curve A but with a higher carbon content (0.06% C).

Curve X describes the equilibrium condition at different temperatures for the reaction $$4Cr+3O_2(g)=2Cr_2O_3(s) \quad (2)$$

with a chromium content of 18%.

The diagram also shows the equilibrium curves for two different silicon content values (0.5 and 0.2% Si) for the reaction $$Si+O_2(g)=SiO_2. \quad (3)$$

From the positions of the curves A and A' it can be seen that the oxygen potential of carbon increases as its percentage content in the melt falls, which explains the phenomenon that carbon becomes increasingly difficult to eliminate.

At the temperatures $T_A$, $T_B$ and $T_C$ and with carbon monoxide partial pressures of 1, 0.1 and 0.03 atmosphere respectively, there is equilibrium in the carbon-chromium system with carbon content of 0.03% and chromium content of 18% selected for the example shown. From FIG. 1 it can be seen that the equilibrium temperature falls with a falling carbon monoxide partial pressure. This implies that it should be possible to achieve the desired carbon content at a lower temperature with equilibrium-induced chromium oxidation by reducing the carbon monoxide partial pressure, thus attaining the aim of reducing the wear on the lining while at the same time to a very considerable extent lessening the heavy oxidation of chromium by oxygen.

The method of the present invention can be carried out in the converter shown in FIG. 2 and FIG. 3 together with the gas supply system shown in FIG. 4.

The converter shown in FIGS. 2 and 3 is generally designated 1 and comprises a cylindrical wall 2, a bottom 3 and a fairly narrow mouth 4 for charging and pouring the melt 10, together with a fume extractor 5 placed above the mouth 4.

The cylindrical wall 2, of internal diameter of about 100 cm, contains two tuyeres 6 and 7. These are not disposed diametrically opposite each other, but are so sited that their axes form an angle of about 90°. Each tuyere 6 and 7 consists of two axial tubes, namely an inner tube 8*a* and 8*b* surrounded by an outer tube 9*a* and 9*b* respectively, mounted in the converter wall 2. The inner tubes 8*a* and 8*b* are connected to a gas supply main 8 (FIGS. 3 and 4) and the outer tubes 9*a* and 9*b* to another gas supply main 9. The overall depth of the melt during the experiments was about 100 cm, and the distance between the surface 11 of the melt and the mouths of the tuyeres 6 and 7 about 80 cm.

The gas supply system shown schematically in FIG. 4 includes a steam generator 20, a moisture separator 21 and a superheater 22. Oxygen can be introduced through an oxygen pipe 23, nitrogen through a nitrogen pipe 24 and argon through an argon pipe 25 from sources not shown in the illustration. The oxygen can be heated in a preheater 26 (heat-exchanger) by means of steam from the steam generator 20. The nitrogen and argon pipes 24 and 25 are connected to each other by a connecting pipe 27 and by another connecting pipe 28. The first connecting pipe 27 is in turn connected to a steam supply pipe 29 at a point between the moisture separator 21 and the heater 22. The other connecting pipe 28 is connected to the oxygen pipe 23 by means of a pipe 30 at a point downstream of the preheater 26. Valves are also provided at various points in the system, e.g., at 32, and are shown in the same manner at other points in FIG. 4. The gases in the system can be mixed in different proportions as desired. Controls are provided for adjusting the gas flow, temperature, etc., but are not shown in the illustrations.

The following Examples are given to illustrate the invention:

In the Examples, steel was first melted in an electric arc furnace and then placed in a converter. The charge weight was about 5.5 tons in all cases. In the Tables $m_N^3$ indicates normal cubic meters, i.e. the value obtained by recalculating the measured value to the volume ratio applicable to a temperature of 25° C. and a pressure of 1 atm. Tons are Metric tons. Apparatus of the type illustrated in FIGS. 2–4 was used.

EXAMPLE 1

Figure 5:
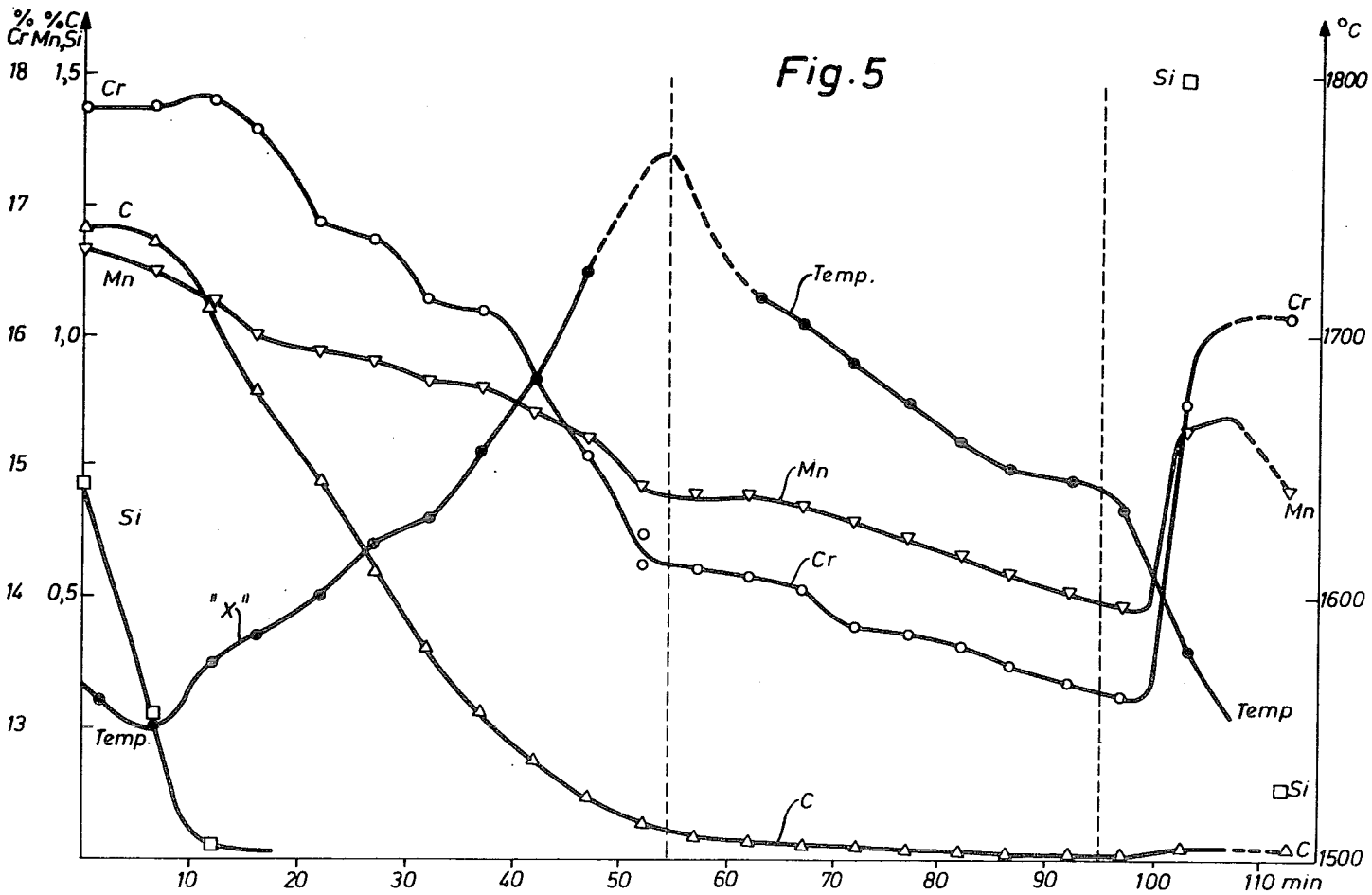
FIGS. 5–7 are graphs illustrating the temperature changes together with the changes in the percentage content of the various elements in a steel melt during experiments in accordance with the invention.

The metallic melt was charged into a converter 1 together with 200 kg. of CaO and slag-forming material. The initial analysis is shown in Table 1. During the first blowing 110 normal cubic meters of oxygen and 61 normal cubic meters of steam were introduced, having first been heated to about 300° C.; the $O_2$:$H_2O$ volume ratio was at all times about 2:1. Oxygen was blown in through outer tubes 9*a* and 9*b*. During this first blowing the temperature rose from 1560° C. to about 1775° C. The changes in the composition of the steel can be seen from Table 1 and the diagram in FIG. 5, which shows variation of temperature and % Cr, Mn and Si with time.

After the first blowing, pipe 23 was closed and nitrogen was brought into inner tubes 8*a* and 8*b* through pipes 24, 28, 30 and 8 in order to prevent inner tubes 8*a* and 8*b* from becoming blocked with solidified steel when the oxygen supply was cut off. Superheated steam can also be used instead of nitrogen for this purpose, but the equipment used in this Example was not such as to permit this. This alternative is, however, indicated in FIG. 4 by means of the broken line 31 between pipes 9 and 8. The second blowing lasted for 40 minutes, 43 normal cubic meters of steam being blown into the melt. The break-down of the steam into oxygen and hydrogen together with the heating of the steam to the bath temperature exerted a pronounced cooling effect, so that the temperature of the melt dropped to 1640° C. during this second blowing. The carbon content at the completion of blowing was only 0.005%. The chromium content had fallen to 13.2% in the melt.

Figure 6:
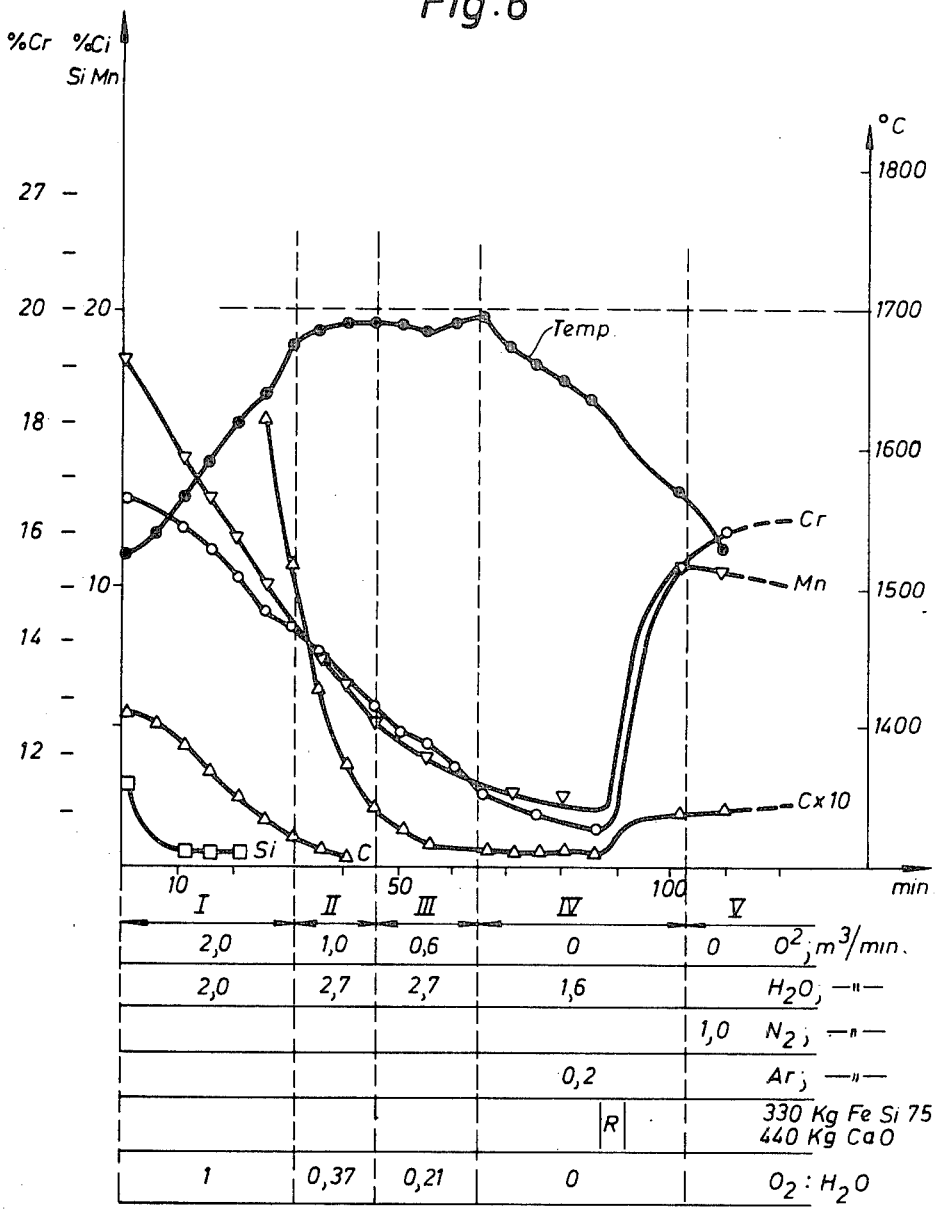

In order to reduce the chromium and manganese which had been oxidised and had accumulated in the slag 150 kg. of ferrosilicon (75% Si) were introduced. This quantity was not entirely sufficient to reduce all the chromium in the slag. In addition 100 kg. of CaO were introduced in order to neutralise the $SiO_2$, the melt being blown with argon for four minutes in order to intensify slag reduction by stirring and expel excess hydrogen from the bath. The final result is shown in Table 1 and FIG. 5.

should where possible not be above 1750° C. This Example shows how temperature conditions in the bath can be controlled in accordance with the invention. The same equipment was used as in the preceding Example and the process was carried out in basically the same manner. The progress of this Example is shown graphically in FIG. 6 which shows how temperature and % Cr, c, Si and Mn vary with time.

Initially, the bath temperature was about 1560° C., and the chromium and carbon contents were 16.6% and 1.8% respectively. As refining began, the temperature rose rapidly due to silicon burn-up and, when it approached 1700° C., the steam flow was increased while the oxygen flow was reduced so that the oxygen/steam volume ratio fell from 1:1 to 0.37:1. This sharply reduced the rate of temperature rise. When the temperature was about 1690° C., the oxygen/steam volume ratio was further reduced to 0.21:1 by decreasing the oxygen flow. This held the temperature substantially constant and the carbon content fell to about 0.005%. To reduce the carbon content still further the oxygen supply was cut off entirely during a fourth blowing stage, which allowed the carbon content to be reduced to the extraordinarily low value of 34 ppm. Reducing agents were then introduced in order to reduce the chromium and manganese in the form of oxides which had accumulated in the slag. During this operation the carbon content rose again due to the carbon contained in the reducing agent.

This Example shows that the successive reduction of

TABLE I

| | | | C | Si | Mn | Cr | Ni | Remainder |
|---|---|---|---|---|---|---|---|---|
| | | Steel melt: | | | | | | |
| | | Initial analysis | 1.2 | 0.7 | 1.1 | 17.7 | 6.1 | Fe + impurities |
| | | Final analysis | 0.06 | 0.0 | 0.7 | 14.3 | 6.4 | Fe + impurities |
| Oxidation Stage | First Blowing | Starting temperature | | | 1560° C. | | | |
| | | Final temperature | | | 1750–1800° C. | | | |
| | | Blowing time | | | 54 minutes | | | |
| | | $O_2$ gas blown into melt | | | 110 $m_N^3$ | | | |
| | — | $H_2O$ steam blown into melt | | | 61 " | | | |
| | | $O_2/H_2O$ volume ratio | | | about 2:1 | | | |
| | | Quantity of CaO introduced | | | 200 kg. | | | |

| | | | C | Si | Mn | Cr | Ni | Remainder |
|---|---|---|---|---|---|---|---|---|
| | | Steel melt: | | | | | | |
| | | Final analysis | 0.005 | 0.0 | 0.48 | 13.2 | 6.6 | Fe + impurities |
| Oxidation Stage | Second Blowing | Final temperature | | | 1640° C. | | | |
| | | Blowing time | | | 41 minutes | | | |
| | | $O_2$ gas blown into melt | | | none | | | |
| | | $H_2O$ steam blown into melt | | | 43 $m_N^3$ | | | |
| | | $N_2$ gas blown into melt | | | 8 " | | | |
| | | $O_2/H_2O$ ratio | | | 0:1 | | | |

| | | C | Si | Mn | Cr | Ni | Remainder |
|---|---|---|---|---|---|---|---|
| Reduction Stage | Steel melt: | | | | | | |
| | Final analysis | 0.018 | 0.10 | 0.8 | 16.2 | 6.3 | Fe + impurities (0.07%N) (10ppm H) |
| | Final temperature | | | 1580° C. | | | |
| | Blowing time | | | 4 minutes | | | |
| | Ar gas blown into melt | | | 8 $m_N^3$ | | | |
| | Quantity of reducing agents used: | | | | FeSi (75) | | : 150 kg. |
| | | | | | CaO | | : 100 kg. |

EXAMPLE 2

Figure 9:
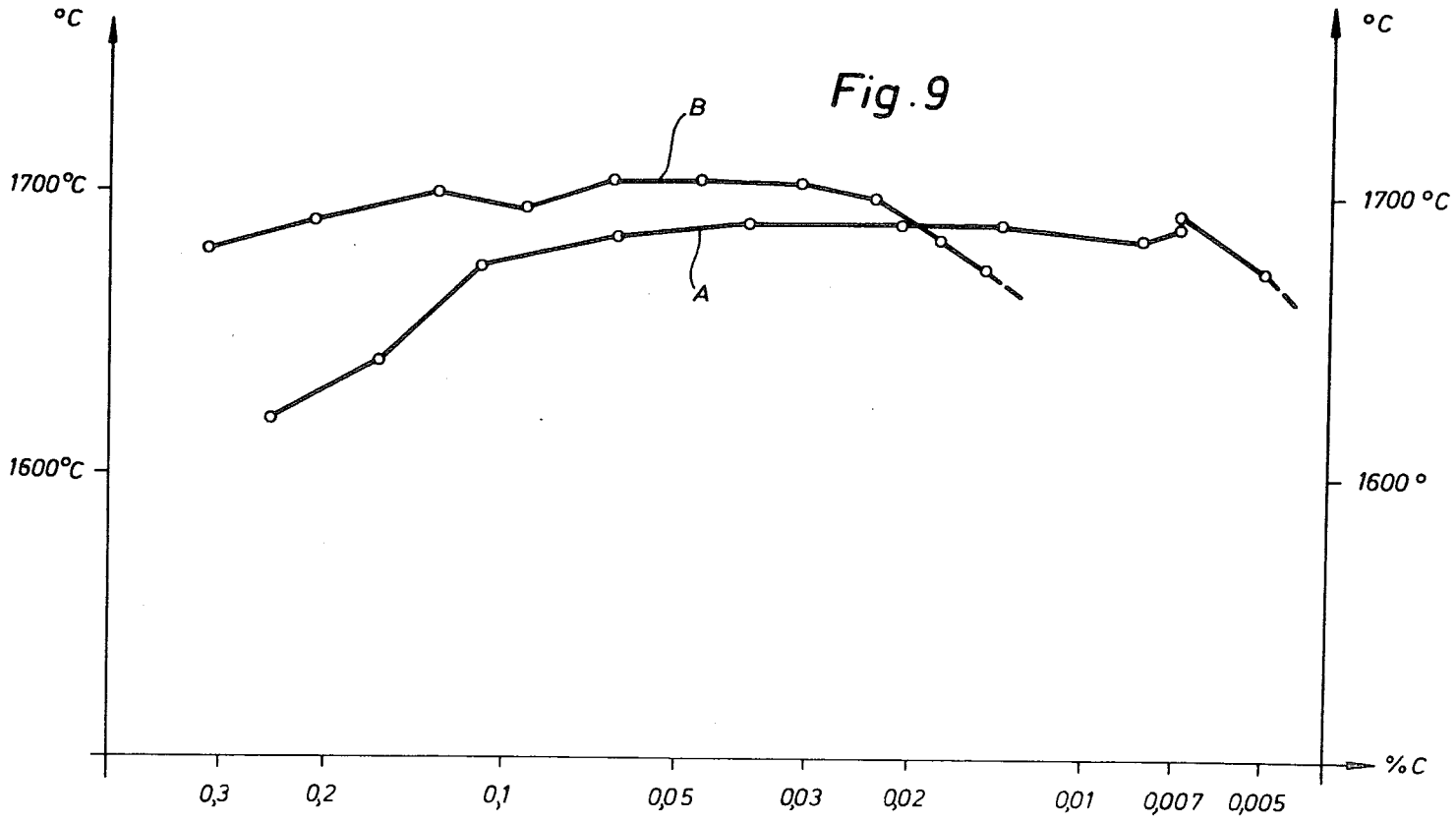
FIG. 9 is a graph showing how temperature conditions in the melt can be controlled in accordance with the invention.

As already mentioned in the introductory remarks above, a high bath temperature involves serious wear on the lining material. It is known that even a comparatively small reduction of the bath temperature dramatically increases lining life. It is therefore desirable that the bath temperature should not exceed 1800° C. and the oxygen/steam volume ratio offers great opportunities of controlling the melt temperature as desired. The excellent opportunities provided by the invention of holding the temperature within very narrow limits, i.e. between about 1650° and 1750° C., during the critical part of the decarburisation process are also illustrated in FIG. 9 in which Curve A relates to Example 2.

EXAMPLE 3

Figure 7:
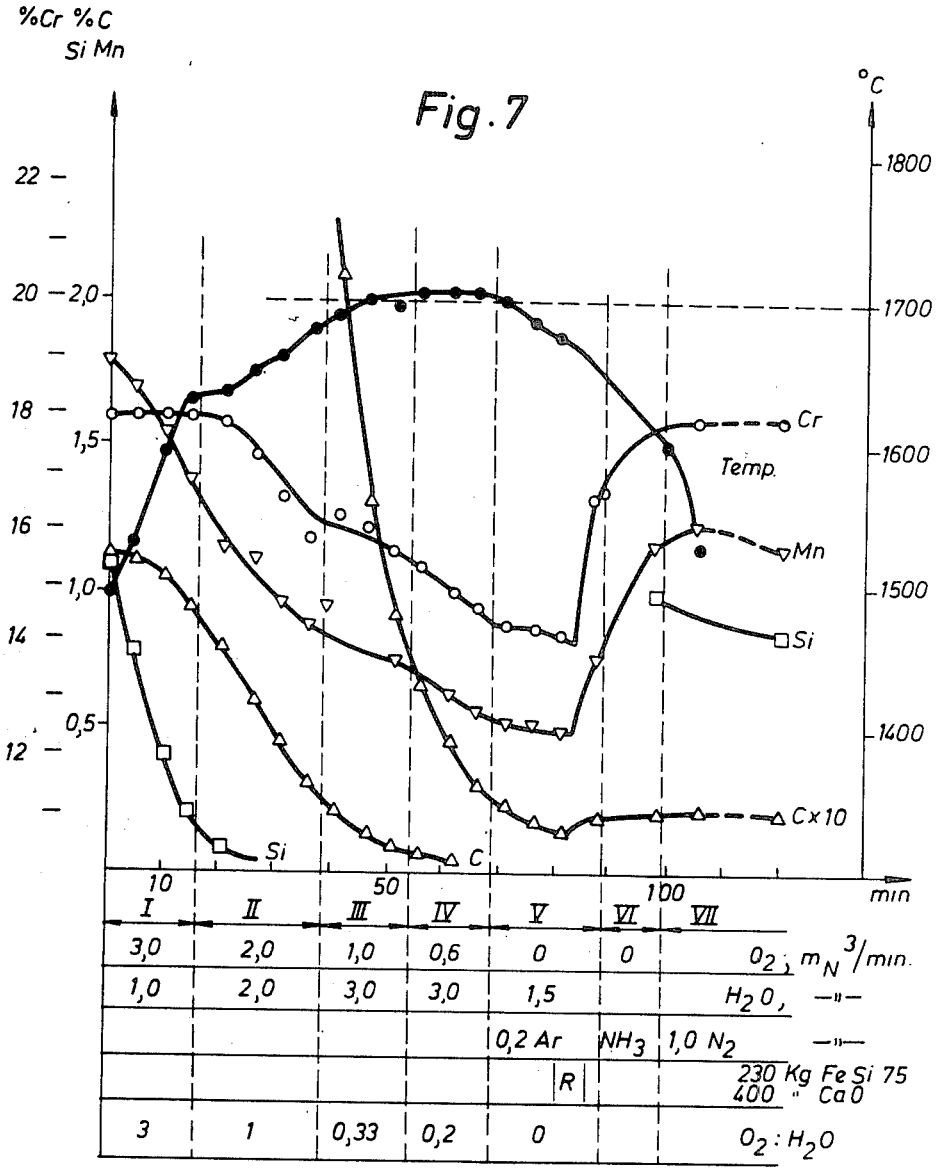

The procedure described in Example 2 was repeated but the number of blowings was further increased. The progress of this Example is shown in FIG. 7 which shows how % Cr, C, Si and Mn and the temperature vary with time. In the first blowing stage, the oxygen/-steam volume ratio was 3:1, giving a rapid temperature rise in the opening part of the process. Three further blowing stages were used with oxygen:steam volume ratios of 0.37:1, 0.21:1 and 0:1 respectively. In a repeat run of the final blowing stage, pure ammonia was used with the object of incorporating nitrogen in the melt. The ammonia decomposed into its basic constituents, the hydrogen dissolving in the same manner as during steam blowing, while the nitrogen also dissolved to a significant extent. When tapping took place the nitrogen content of the steel had thus risen from about 0.03% to about 0.06%. Curve B in FIG. 9 shows how the temperature during this experiment can be held largely constant during a long period of decarburisation.

Discussion of Experimental Results

The Equipment

In a preliminary experiment to which no reference has been made above, use was made of an electric arc furnace in which steam was blown into the bath through a lance inserted into the melt. Some hydrogen dissolved in the melt, but results were difficult to assess since the treatment time was very short because of practical difficulties. The equipment then used had therefore to be regarded, at least for practical purposes, as unsuitable for the process envisaged in the invention. An electric arc furnace can, however, prove suitable if the arrangements for blowing steam into the melt are modified slightly, in which case the invention can offer certain advantages even with this type of furnace, although it cannot be recommended.

Examples 1 to 3 have shown that a converter fitted with blowing-in equipment at a certain depth below the surface of the melt is suitable for use with the invention. Other suitable vessels include ladles, e.g. vacuum treatment ladles, or induction melting furnaces, in combination with a porous brick situated in the bottom of the ladle or preferably one or more tuyeres disposed in the bottom or wall of the ladle, or possibly a lance inserted into the melt for blowing in the process gases. The experiments which were undertaken using the electric arc furnace or the converter indicate that the steam is best introduced into the melt in such a manner that the steam can decompose and remain long enough to give the desired result. No optimum depth was determined, but it may be assumed that the steam is best blown in at least 20 cm. below the surface and where possible at least 50 cm. below the top surface of the bath.

Any device placed or inserted at a suitable depth can be used for blowing the steam provided that this latter is rapidly and intimately mixed with the melt. A porous brick made from a refractory material and situated in the bottom of the process vessel may also be used, as also a suitably shaped lance provided that this is made from a refractory material or is adequately cooled. Tuyeres are particularly suitable. In this connection it is best to introduce the oxygen or oxygen/steam through an inner tube in the tuyere and pure steam through an outer tube which surrounds the inner tube since the decomposition of the steam and, to a lesser extent, the heating of this to the bath temperature effectively cools the tuyeres when such an arrangement is used. It is, however, also possible to introduce the oxygen and the steam into the vessel at different points, but such a system loses some of the advantages of the invention and cannot therefore be recommended.

Conduct of the Process

The Oxidation Stage

No difficulties were encountered in operating the process in accordance with Examples 1 to 3. The melt was entirely under control at all times. The smoke and fumes generated were negligible, which shows that they were accompanied by only very small metal losses in the form of oxides. It is also significant that the process envisaged in the invention offers considerable advantages where environmental factors are concerned, since air pollution is extremely low.

Examples 1 to 3 are intended merely to demonstrate the advantages and fundamental principle of the invention. In this connection it should also be mentioned that considerable advantage can be obtained from the invention even when the refining with a hydrogen containing compound envisaged in the invention is not used throughout the decarburisation process. Thus certain parts of the blowing process may be carried out in accordance with methods already known, the hydrogen compound refining envisaged in the invention being used only during certain parts of the process, in particular when it is necessary to keep the temperature under control.

At the commencement of the oxidation stage, practically all the silicon is oxidised. The initial period of silicon oxidation lasts until the rate of oxidation drops sharply, which is indicated by a 'kink' in the temperature curve (temperature rise decreases), see "X" on graph FIG. 5. The silicon oxidation has the effect of causing a rapid rise in the bath temperature to a suitable level. From this point of view it would, of course, be best to blow pure oxygen into the melt during the initial stage, but this would result in very high temperatures precisely at the point of blowing-in and would damage the tuyeres. It is thus best to introduce a cooling agent together with the oxygen in such manner that the gas mixture shall contain 50–95% by volume, and preferably 60–90% by volume of oxygen, the remainder being constituted by one or more agents for cooling the tuyeres. Such cooling agent may at this stage of the process be argon or nitrogen (nitrogen may be introduced in the form of air, either entirely or partially in such form depending on the quantity of oxygen required) used in accordance with well-known procedures. It may also consist of a hydrocarbon used in a manner known per se, such as natural gas which would probably further increase the rate at which the bath temperature rises. Ammonia and carbon dioxide are cooling agents which should be suitable for use during this blowing period. Nevertheless, the recommended cooling agents for use during silicon oxidation are steam or a gaseous cooling agent consisting as to at least 50% of steam.

The next phase of the oxidation stage may be referred to as the "main decarburisation period". This period is characterised by a marked oxidation of carbon, chromium and manganese together with any other readily oxidised elements which may be present. In order to keep the temperature and the chromium losses under control the oxygen/steam volume ratio during this period should be comparatively low. The experiments have shown that this ratio should not exceed 3:1 and should later be reduced to below 1:1. The appropriate dilution ratio must, however, be determined in each individual case by external circumstances and by the raw material used and the size of the vessel. With a 50-ton converter it may thus be taken that the $O_2/H_2O$ volume ratio during the majority of this period should be at most 2:1, being later reduced to below 1:2 and in certain cases even to below 1:5. Towards the end of this period values as low as below 1:10 may be considered, and the use of pure steam is even a possibility.

During the main decarburisation period, too, the steam may be partially replaced by another diluting gas, but not less than 50% of the diluting gas should consist of steam and/or ammonia. In principle, water can be introduced during this period in liquid form provided that this is done under closely controlled conditions. In view of the explosion risk, however, the water should be introduced in the form of steam, preferably as superheated steam at above 150° C., e.g. between 150° and 500° C.

As a general rule, it can be said that the steam, either alone or mixed with another diluting gas, should be introduced in sufficient quantity and concentration for the carbon monoxide partial pressure in the gas bubbles leaving the bath to be reduced to a level necessary to produce the desired reduction in the carbon content, preferably to below 0.5 atm. and if possible to below 0.3 atm.; if very low carbon levels are desired, a partial pressure below 0.1 atm. will be required. If steam treatment is combined with simultaneous vacuum treatment, which is in itself possible, it is possible to achieve extremely low carbon monoxide partial pressures, allowing extremely low carbon content values to be obtained. These can be put to advantage for producing, for example, extremely low carbon ferritic and austenitic stainless steels.

Intermediate Stage

In Examples 1 to 3 no intermediate stage was introduced between the oxidation stage and the reduction stage. An intermediate stage can, however, be introduced under production conditions, when a certain amount of oxygen dissolves in the melt. A certain amount of carbon will also remain in the melt. The intermediate stage can then, by stirring the melt, stimulate the transport of carbon in the bath while the carbon monoxide partial pressure is maintained low enough to permit the residual carbon to react with the dissolved oxygen to give carbon monoxide. For this purpose a gas containing no oxygen is introduced into the melt, e.g. argon, nitrogen or hydrogen. It is also possible, as was done at the end of the process in Example 3, to introduce ammonia at this stage so that not only is a low partial pressure obtained as a result of the hydrogen produced, but in addition the nitrogen content of the melt is increased. The hydrogen dissolved in the melt during the preceding oxidation stage should also assist in achieving effective intermediate treatment. If only argon is introduced during the intermediate stage, it and the high hydrogen content of the melt should work together to produce the desired reduction in carbon content during this period. A small quantity of oxygen may also be mixed with the argon with the object of ensuring the presence of a sufficient amount of oxygen during the final elimination of carbon.

The process can be stopped at this point if a very low-carbon steel or other low-carbon alloy is required.

Figure 8:
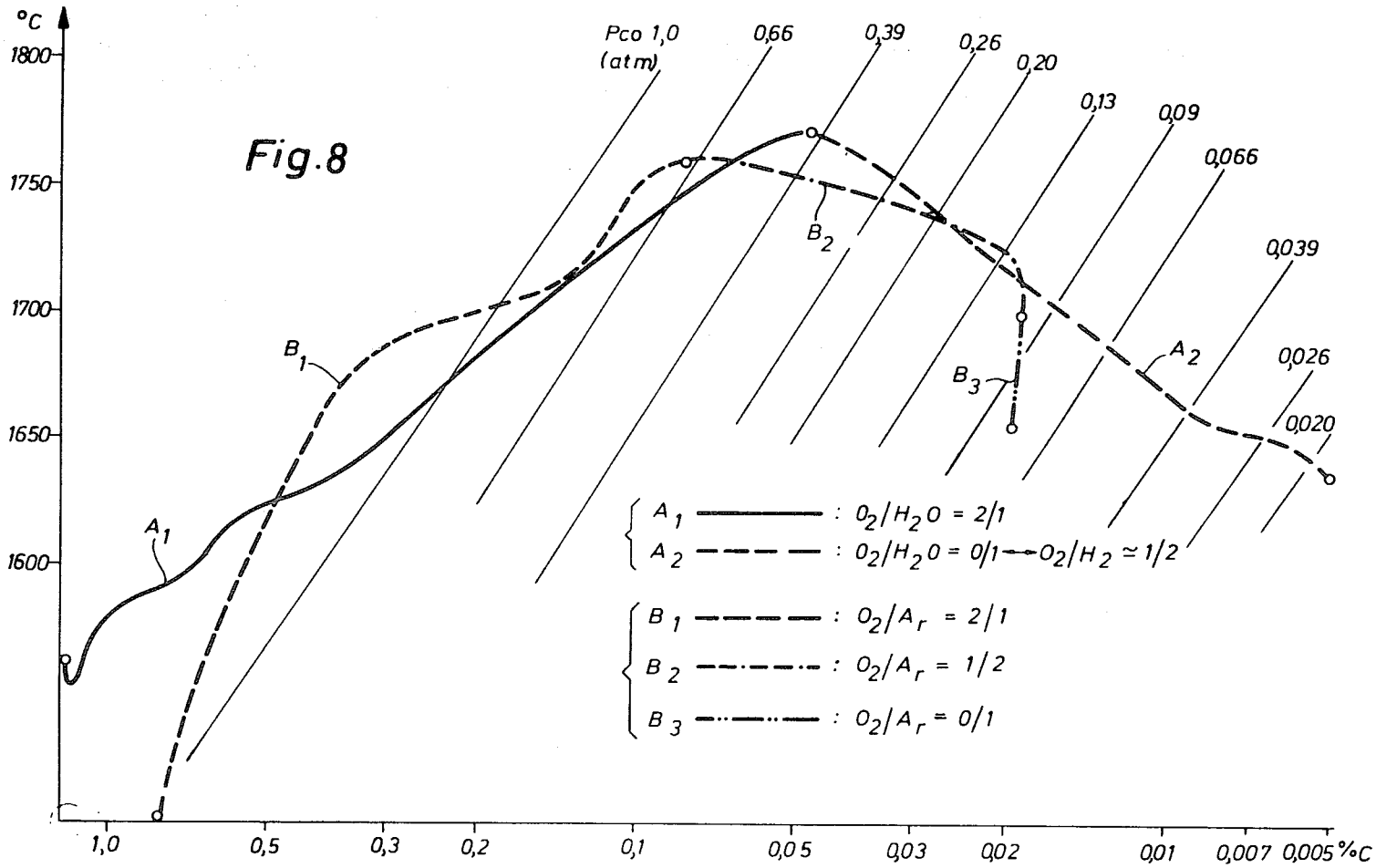
FIG. 8 is a graph illustrating the functional relationship between carbon content reduction and temperature in the melt during a first experiment in accordance with the invention.

The superior results obtained in Example 1 using steam during the oxidation stage as compared with the results obtainable by conventional argon treatment under corresponding conditions will now be explained in detail by reference to FIG. 8. Curve A in FIG. 8 illustrates the process of the invention as carried out in Example 1. Curve B illustrates the blowing of a melt containing about 18% chromium and about 8% nickel in the converter used in Example 1, the melt being blown with argon-oxygen in accordance with a procedure already known. The diagram also contains isobars for the carbon monoxide partial pressure ($P_{CO}$) in equilibrium with the carbon content of the melt and the maximum quantity of oxygen which the melt can contain with about 18% chromium and about 8% nickel. As a general principle it can be said that the lower the $P_{CO}$ which can be achieved by other means than cooling the melt, the lower the carbon content obtainable.

The $A_1$ and $B_1$ portions of the diagram are first compared. The $O_2/H_2O$ and $O_2/Ar$ volume ratios were in each case 2:1. The $A_1$ and $B_1$ portions of the diagram show that dilution with argon (Curve $B_1$) does not produce such rapid initial decarburisation as does dilution with steam. The reason for this phenomenon is difficult to see, but the phenomenon indubitably constitutes an advantage of the process envisaged in the invention. At the conclusion of the $B_1$ period, it is seen that $P_{CO}$ cannot be reduced below 0.8 atm. without a considerable increase in temperature, leading in turn to considerable chromium oxidation. The $A_1$ curve develops in a different manner. $P_{CO}$ falls continuously in the desired manner with the $A_1$ curve, to reach a value of about 0.4 atm., while the carbon content falls at the same time to a value as low as 0.5%, which is fully adequate for many applications of the steel. During the next period of Experiment 1 (Curve $A_2$) pure steam was blown into the melt, corresponding in this connection approximately to an oxygen/hydrogen ratio of 1:2. The $B_2$ curve represents the same blowing using an oxygen-argon mixture having an $O_2/Ar$ volume ratio of 1:2.

The two curves are initially fairly similar during this blowing period, but at its conclusion the $B_2$ curve drops abruptly before $P_{CO}$ has reached about 0.1 atm. The $A_2$ curve, on the other hand, continues with a continuous fall in the CO partial pressure. The experiment was discontinued when the melt temperature had fallen to about 1630° C., the CO partial pressure being then below 0.020 atm. and the carbon content having fallen to the very low value of 0.005%. This is, however, not necessarily the bottom limit for the process envisaged in the invention, a view which is reinforced by the results obtained in Example 2. It may be assumed that if the experiment had been undertaken in a converter of larger capacity, in which the temperature losses to the environment are relatively smaller, it would probably have been possible to continue decarburisation even further.

The $B_3$ curve, representing the intermediate stage of the process, shows that when blowing is carried out with pure argon the oxygen in solution in the melt cannot be utilised for oxidising the residual carbon. The reduction of the CO partial pressure therefore depends entirely on the cooling of the melt in this case. It may, however, be assumed that had pure argon been blown into the melt treated with steam in accordance with the invention a continued reduction of the carbon content would have been obtained due to the presence of a comparatively large amount of residual hydrogen in the melt. It is therefore recommended that a compound containing neither oxygen nor carbon, preferably argon or, for special purposes, nitrogen or ammonia, be blown into the melt as a final decarburisation treatment immediately after the final steam blowing. Such intermediate treatment with argon or nitrogen would at the same time also eliminate excess hydrogen in the melt.

Reduction Stage

The purpose of the reduction stage is to recover by reduction the chromium or other readily oxidised valuable metals, such as manganese, which have been oxidised and have accumulated in the slag in the form of readily reducible oxides. For this purpose it is possible to add ferrosilicon, silicochromium, aluminium or some other powerful reducing agent, i.e. an agent having a greater affinity for oxygen than is exhibited by chromium and the other valuable metals which it is desired to recover. The reducing agent should be added in a quantity sufficient to recover the metals in question by reducing their oxides present in the slag. During this reduction process it is also possible to increase the silicon content of the melt to the desired level and to adjust the alloy composition of the melt in other respects. The reduction stage may in certain cases replace the intermediate stage discussed above since during the reduction stage the melt is blown with a compound containing neither carbon, oxygen nor hydrogen, being for preference argon and/or nitrogen. It is also possible to blow with, for example, ammonia during or after reduction as was shown in Example 3, in order to increase the nitrogen content of the steel melt. During the reduction stage the amount of hydrogen dissolved in the steel is reduced to a satisfactorily low level if such level has not already been attained during the above-mentioned intermediate treatment. For stainless steel the hydrogen content can be permitted to be as high as 10–12 ppm.

We claim:

1. A method of reducing the carbon content of a carbon-containing alloy, said alloy containing at least 10by weight of chromium and, as the major component thereof, at least one metal selected from the group consisting of iron, cobalt and nickel, said method comprising:

(a) first melting the alloy and bringing the molten alloy substantially up to the decarburization temperature essentially by oxidising substantially completely any silicon present in the alloy and optionally, any other oxidizable component present in the alloy, (b) thereafter, decarburizing the alloy at a decarburization temperature of about 1550° to about 1800° C. by introducing into the molten alloy at a depth of at least about 20 cm below the surface thereof:

1. oxygen; and
2. at least one hydrogen containing compound selected from the group consisting of steam and ammonia; and
3. nitrogen; said oxygen oxidising carbon in the alloy to carbon monoxide, the volume ratio of the introduced oxygen to the hydrogen containing compound during at least part of the main decarburization period being below 3:1, said hydrogen containing compound liberating elementary hydrogen in the molten alloy, said nitrogen and elementary hydrogen working as diluting gas for said oxygen in the molten alloy, the amount of diluting gas and carbon monoxide in the molten alloy being such that the partial pressure of carbon monoxide in the molten alloy is below 0.5 atmospheres and lower than that partial pressure which corresponds to the equilibrium pressure for the carbon/chromium oxidation, (c) maintaining the molten alloy at a decarburization temperature of at least about 1500° C. essentially by oxidizing chromium in the alloy, wherein the decarburization temperature is at least partly controlled by varying the volume ratio of introduced oxygen to hydrogen-containing compound, said ratio being decreased during the course of the decarburization to below 1:1, using amounts and concentrations such that the decarburization temperature is essentially maintained at no greater than about 1800° C., and, (d) thereafter removing at least part of the hydrogen remaining in the molten alloy.

2. A method according to claim 1 wherein the oxygen or a mixture of the oxygen and a part of the hydrogen-containing compound is introduced through the innermost tube of a tuyere containing at least two co-axial tubes and at least a part of the hydrogen containing compound is introduced through a tube other than the innermost tube of the tuyere and wherein the nitrogen is introduced through at least one of the tubes of the tuyere, the tuyere opening into the molten alloy at a depth of at least about 20 cm below the surface thereof.

3. A method according to claim 1, wherein the temperature during a major portion of the decarburization period is maintained at about 1600°–1750° C. by adjusting the amounts and concentrations of oxygen and nitrogen and hydrogen containing compound in the molten metal during this period.

4. A method according to claim 3, wherein the volume ratio of the introduced oxygen to the hydrogen containing compound during the decarburization initially is below 3:1, said ratio being decreased during the course of the decarburization to 1:1 to 1:10.

5. A method according to claim 4, wherein the volume ratio of the introduced oxygen to the hydrogen containing compound during the majority of the decarburization stage is at most 2:1 and later reduced to below 1:2.

6. A method according to claim 5, wherein said volume ratio towards the end of the decarburization period is decreased to below 1:10.

7. A method according to claim 6, wherein only said hydrogen containing compound is introduced at the end of the decarburization period.

8. A method according to claim 1, wherein prior to the silicon oxidation, the alloy contains at least 0.7% by weight silicon, which is all oxidized.

9. A method according to claim 8 wherein, during the silicon oxidation period, a gas mixture is introduced into the molten metal below the surface thereof, said gas mixture containing 50–95% by volume of oxygen, the remainder being constituted by at least one agent selected fron the group consisting of argon, nitrogen, hydrocarbons, ammonia, carbon dioxide and steam, for cooling the devices used for the gas injection.

10. A method according to claim 9 wherein, at least 50% by volume of said gas mixture is steam.

11. A method according to claim 2, wherein the tuyere opening is arranged at least 50 centimeters below the surface of the molten metal.

12. A method according to claim 1 wherein chromium present in the slag which has been accumulated on the surface of the molten metal is recovered by reduction.

13. A method according to claim 1 wherein any excess hydrogen present in the molten alloy is removed by blowing a scavenging gas which contains no hydrogen through the molten alloy.

* * * * *